United States Patent [19]

Ranzer

[11] Patent Number: 4,651,352

[45] Date of Patent: Mar. 24, 1987

[54] ADJUSTABLE CAP

[75] Inventor: Norman W. Ranzer, Narberth, Pa.

[73] Assignee: Keystone Adjustable Cap Company, Pennsauken, N.J.

[21] Appl. No.: 712,290

[22] Filed: Mar. 15, 1985

[51] Int. Cl.[4] ..... A42B 1/22

[52] U.S. Cl. ..... 2/197

[58] Field of Search ..... 2/197, 195, 198, 200, 2/175

[56] References Cited

U.S. PATENT DOCUMENTS

| | | | |
|---|---|---|---|
| 230,845 | 8/1880 | Weiler . | |
| 1,163,313 | 12/1915 | Blechman . | |
| 1,461,189 | 7/1923 | Hennegan . | |
| 1,806,225 | 5/1931 | Vernon . | |
| 1,868,281 | 7/1932 | Falkson . | |
| 1,886,992 | 11/1932 | Wagenfeld . | |
| 1,997,678 | 4/1935 | Cremen . | |
| 2,051,084 | 8/1936 | Hertz . | |
| 2,373,399 | 4/1945 | Johnson . | |
| 2,561,857 | 7/1951 | Goldman . | |
| 2,669,725 | 2/1954 | Haegele . | |
| 2,748,396 | 6/1956 | Lipschutz et al. . | |
| 2,825,328 | 3/1958 | Olsen . | |
| 2,856,608 | 10/1958 | Wagenfeld . | |
| 2,990,552 | 7/1961 | De Villers . | |
| 3,321,774 | 5/1967 | Tames . | |
| 3,383,709 | 5/1968 | Bauer . | |
| 3,390,405 | 7/1968 | Gruber . | |
| 3,419,910 | 1/1969 | Welch | 2/198 |
| 3,523,303 | 8/1970 | Wagenfeld . | |
| 4,021,859 | 5/1977 | Burke | 2/197 |
| 4,055,857 | 11/1977 | Brucciani . | |
| 4,186,446 | 2/1980 | Maney . | |
| 4,213,206 | 7/1980 | Maney . | |
| 4,244,058 | 1/1981 | Randall . | |
| 4,282,607 | 8/1981 | Randall | 2/197 |
| 4,286,338 | 9/1981 | Maney . | |
| 4,370,756 | 2/1983 | Gallin . | |

FOREIGN PATENT DOCUMENTS

| | | |
|---|---|---|
| 547459 | 8/1942 | United Kingdom . |
| 1030093 | 5/1966 | United Kingdom . |
| 1129863 | 10/1968 | United Kingdom . |
| 1264437 | 2/1972 | United Kingdom . |

*Primary Examiner*—Peter Nerbun

*Attorney, Agent, or Firm*—Seidel, Gonda, Goldhammer & Abbott

[57] ABSTRACT

An adjustable cap includes a pleated crown whose central pleats have less transverse dimension than the lateral pleats to better maintain the contour of the crown for front and rear head room for relatively small cap sizes. The pleats are secured to each other at the rear of the cap to prevent exposure of the head between the crown and headband.

10 Claims, 15 Drawing Figures

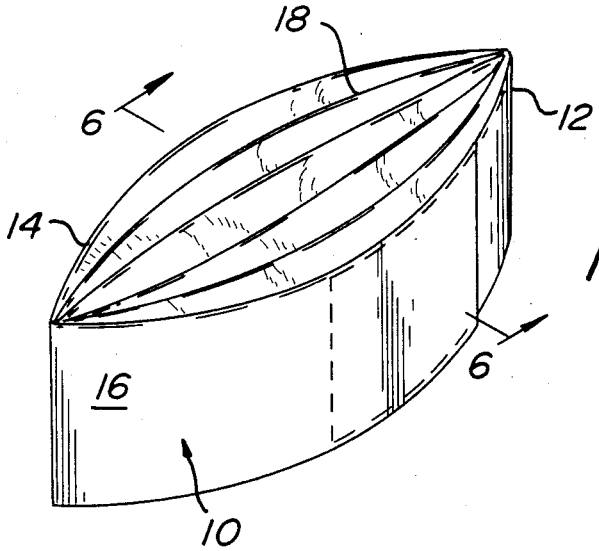
FIG. 1
FIG. 2
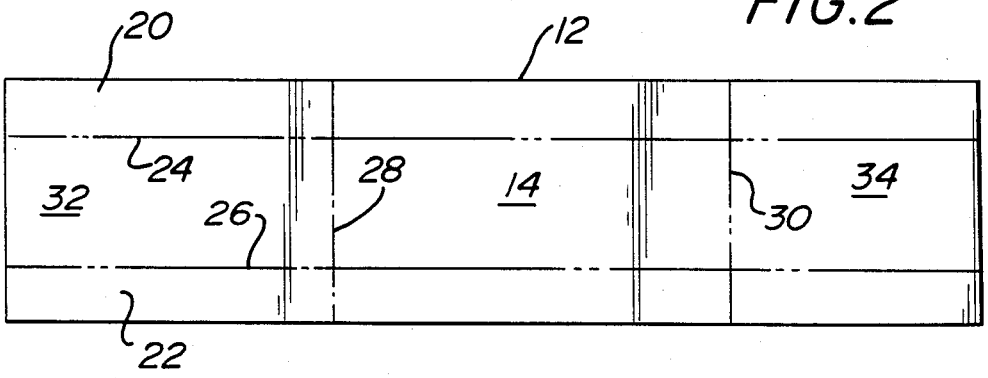
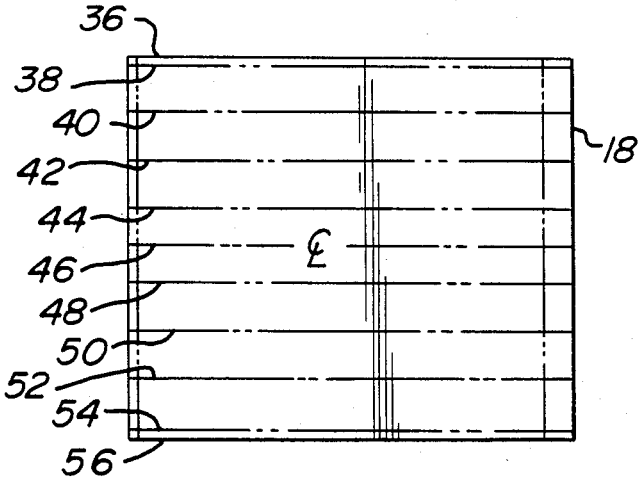
FIG. 3

ADJUSTABLE CAP

BACKGROUND OF THE INVENTION

This invention relates to an adjustable cap, and more particularly to an improvement in the pleated crown of such an adjustable cap.

Adjustable caps, particularly adjustable paper caps are widely used for commercial purposes where it is necessary to prevent hair and other particles from getting into the work product. This typically includes situations where it is necessary to maintain sanitary conditions, such as the preparation of food. It may also include the manufacture of electronic components where particle free conditions must be maintained.

Today, the typical adjustable cap includes two basic components, namely a headband with its ends telescopically interconnected for head size adjustment and a pleated crown secured to the headband. Examples of such cap construction are found in U.S. Pat. Nos. 4,186,446; 4,286,338; and 4,244,058. Yet another example of this basic combination is described and illustrated in U.S. Pat. No. 4,213,206. Moreover, caps incorporating this combination of adjustable headband and pleated crown have been available commercially for a number of years including caps sold by the assignee of this patent application, Keystone Adjustable Cap Company, Inc. of Pennsauken, N.J. and its competitors.

All such caps more than adequately serve the purpose of providing a disposable adjustable cap. But they suffer from certain defects when used at the extremeties of their size adjustment, that is when used for small heads or for extra large heads. When used on small heads, the transverse contour of the folded pleats as they expand do not provide good room at the central portion of the head because the lowermost edges of the pleats do not expand sufficiently to provide head room. As a result, the cap has a tendency to stand up on the wearer's head. At extra large sizes, the crown tends pop out of the head band at its rear end thereby exposing the wearer's hair.

More particularly, by observing prior art adjustable caps in use it can be seen that the lower marginal edges of the pleated panels of the crown project downwardly into the interior of the cap. Upon opening the cap they tend to rise as the crown is extended to cover the wearer's head. This continues until the pleated crown is extended to its fullest extent. But for persons having a smaller head size, such full extension does not occur. This means that the lower marginal edges of the pleated panels project further downwardly and contact the hair or scalp thereby tending to displace the cap upwardly or give the crown an unsightly appearance as it displaces improperly. The present invention overcomes this problem by providing a configuration for the pleated panels of the crown which provides more space within the cap for the wearer of a smaller cap size.

For the wearer of a larger cap size, another problem occurs. The rear part of the crown pop out and extend above the band exposing the wearer's head thus defeating the protection afforded by the cap. This occurs because only a short length of the folded over portion of the outermost pleated panel is secured to just one of the sections of the telescoping side panels. As the side panel is elongated by displacing the telescoping sections, their appears an even longer length of headband to which the crown is not attached. As the wearer puts the hat on his or her head, the crown is easily pushed above the band thereby exposing the wearer's head.

The present invention overcomes these problems.

SUMMARY OF THE INVENTION

The present invention is intended to provide a new adjustable cap construction which helps resolve the problems found to exist in prior art caps. More specifically, the present invention provides a new crown construction in which the transverse dimension of the central pleated panels of the crown is made smaller than the corresponding transverse dimension of the lateral pleated panels, that is, the panels closer to the headband. However, the upper marginal edge of the fold lines of said pleated panels remain evenly spaced from the upper edge of the headband. Consequently, the lower folded marginal edges of the central pleated panels do not project as far down when the cap is placed on the wearer's head, particularly in the case of a person who uses a relatively small hat size. The consequences of this construction are two fold. The first is that the crown does not project down as far in the central portion thereby providing more interior space for the head of the wearer. Still further, the crown tends to maintain its overall contour, expecially for smaller hat sizes, thereby providing more room in the front and back of the head.

To prevent the crown from popping out and exposing the wearer's head, the present invention provides one or more spots of glue between each of the pleated panels at a position adjacent the rearmost portion of the headband. In a preferred embodiment of the invention, the panels are secured to each other by a spot of glue within that portion of the pleated panels which is reverse folded back upon itself when the crown is in its collapsed, fully folded configuration. Securing the pleated panels to each other causes the crown to retain its desired configuration even when the band is expanded to its relatively larger sizes.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 1 is a perspective view of an adjustable cap embodying the present invention.

FIG. 2 is an elevational view of the sheet which, when folded, will form the headband.

FIG. 3 is an elevational view of the sheet which, when folded, will form the pleated crown of the adjustable cap.

DESCRIPTION OF ILLUSTRATIVE EMBODIMENTS OF THE INVENTION

Figure 4:
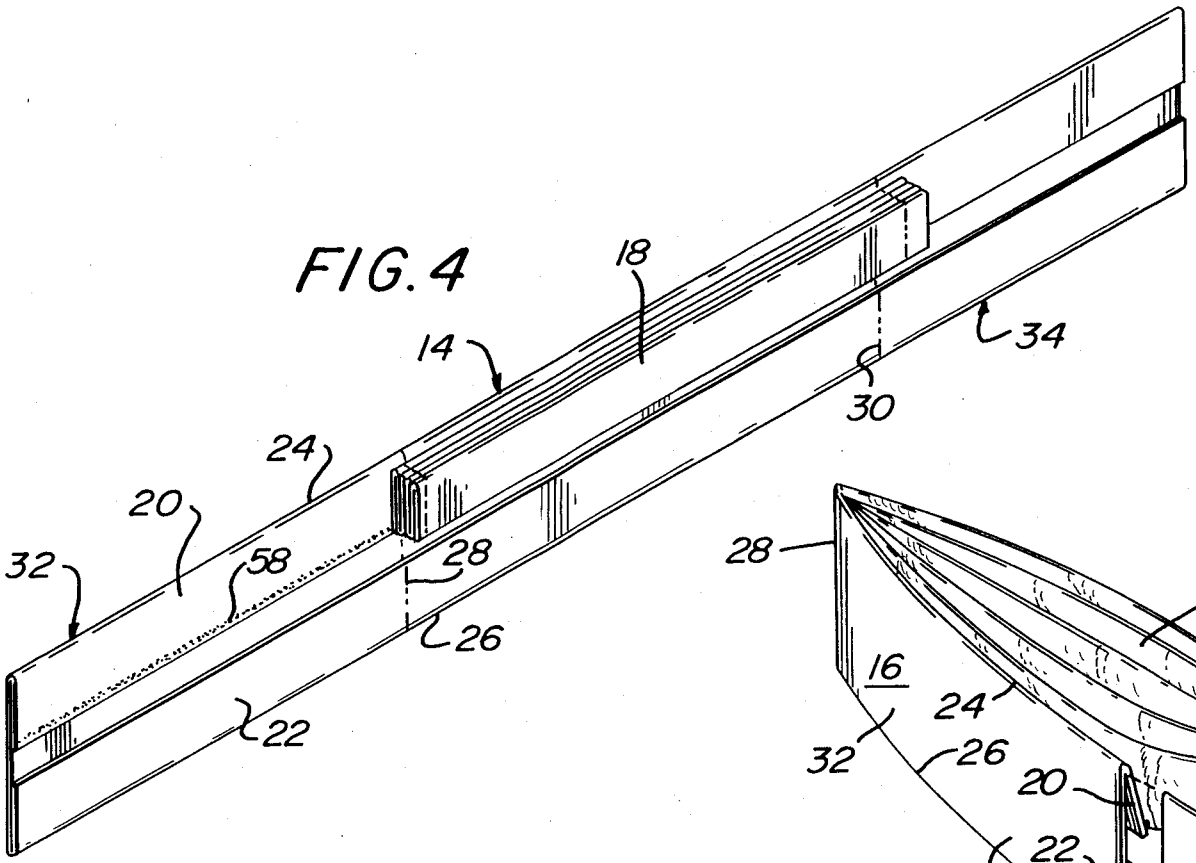
FIG. 4 is a perspective view of a partly folded headband with the pleated, collapsed crown secured to one section thereof.

Referring now to the drawings in detail, wherein like numerals indicate like elements, there is shown in FIG. 1 a perspective view of an adjustable cap indicated generally as 10 and incorporating the features of this invention. The cap 10 is preferably made of paper although it can be made of other materials including woven and nonwoven fabrics. Cap 10 includes a band 12 defined by a pair of longitudinally extending side panels 14 and 16. The cap 10 also includes a pleated crown which extends across the space between the side panels 14 and 16 and is expandable to accommodate a wearer's head.

Figure 5:
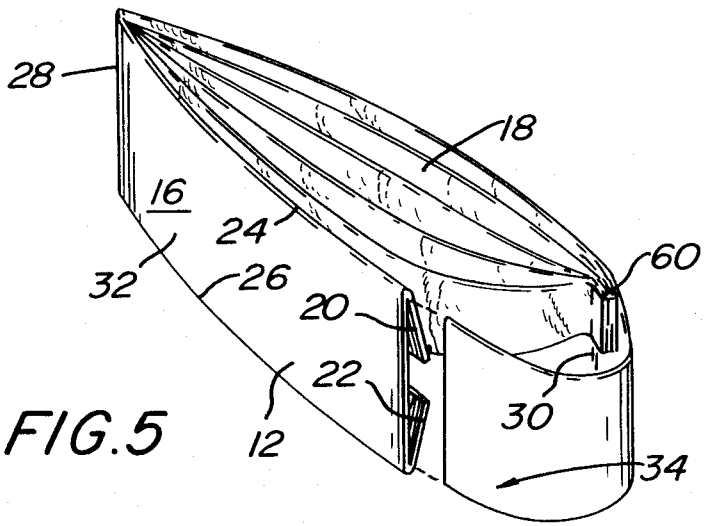
FIG. 5 is a perspective view of the cap showing how one side panel of the cap is formed by telescopically joining two sections thereof.

The construction of the headband 12 is more fully illustrated in FIG. 2 which shows in elevation the sheet of paper from which the band is formed. The band 12 includes upper marginal edge portion 20 and lower marginal edge portion 22 which are formed by folding the same along the fold lines 24 and 26, respectively, toward the center of the sheet. This is illustrated in FIGS. 4 and 5. As thus constructed, fold line 24 will also define the top edge of the cap and fold line 26 the lowermost edge of the cap.

The side panels 14 and 16 are defined by the transverse fold lines 28 and 30. As shown, side panel 14 lies between fold lines 28 and 30. Side panel 16 is made up of front and rear sections 32 and 34 with rear section 34 telescoping into front section 32 as illustrated in FIG. 5. Since the cap 10 is made of a flexible material, the telescopic fit of the two sections 32, 34 is readily accomplished even though they are folded to the same dimensional width.

The pleated crown 18 is folded from a sheet of material that is relatively thinner than the material from which the band 12 is made. As illustrated in FIG. 3, the crown 18 is pleated into its desired configuration by providing between the marginal edges 36 and 56, a plurality of parallel fold lines 38 through 54. It should be noted that the fold lines 38-54 are not all equally spaced from each other. Rather, the fold lines on either side of the central line 46 are more closely spaced to the central fold line than are the lateral-spaced fold lines closer to the edge margins 36 and 56.

The following is a chart illustrating the transverse width of each of the longitudinal pleated panels for a cap wherein the dimensions of the head band 12 in its folded position are-overall width—$3\frac{1}{2}$ inches; upper marginal edge 20—$1\frac{1}{2}$ inches, lower marginal edge 22—$1\frac{3}{8}$ inches; side panel 14—$10\frac{3}{4}$ inches; front section 32—$8\frac{7}{8}$ inches, rear section 34—$6\frac{3}{4}$ inches:

| Fold Line No. | Dimension Inches |
|---|---|
| 36–38 | .125 |
| 38–40 | 1.125 |
| 40–42 | 1.125 |
| 42–44 | 1.125 |
| 44–46 | 1.000 |
| 46–48 | 1.000 |
| 48–50 | 1.125 |
| 50–52 | 1.125 |
| 52–54 | 1.125 |
| 54–56 | .125 |

The crown 18 is formed from a sheet of material which is 9 inches in width and $11\frac{3}{4}$ in length.

The foregoing dimensions are for purposes of illustration only. They may be varied as desired in accordance with the principles of the present invention.

Figure 6:
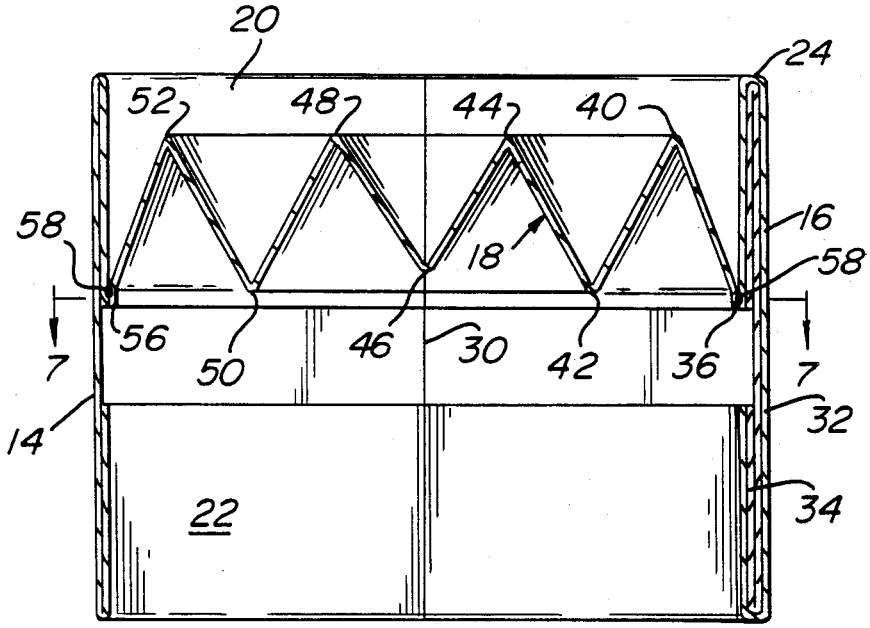
FIG. 6 is a vertical sectional view of the cap taken along the lines 6—6 in FIG. 1.

The purpose in making the central pleated panels of less transverse width than the outer pleated panels become apparent from a description of the fully assembled cap 10 as best illustrated in FIG. 6.

The crown 18 is assembled to the head band 12 by applying a narrow strip of adhesive 58 (FIG. 4) to that part of the upper marginal edge portion which is within the front section 32, within the side panel 14, and extends a short distance beyond fold line 30 into the rear section 34. The adhesive strip 58 is positioned closely adjacent the lower edge of upper marginal edge portion 20.

The crown 18 is affixed to the head band 12 by adhering it between the edge 36 and fold line 38 and between the edge 56 and fold lines 54 as best illustrated in FIGS. 4 and 6. It should be noted that the positon of attachment between the crown and head band need not be closely adjacent to the edge margins of the pleated crown. It could be anywhere up to approximately two-thirds of the distance from the edge margins to the first fold lines that define an upper peak, namely fold lines 40 and 52.

As illustrated in FIG. 4, the longitudinal length of the crown is such that it extends over the fold line 28 which will ultimately define the front end edge of the cap 10. The crown also extends over the fold line 30 which ultimately will define the rear end edge of the cap. To complete the construction of the cap, the section 32 is folded along the fold line 28 and the remaining portion of the adhesive strip 58 is adhered to the outermost pleated panel of the crown 18. A small portion of the front end of the crown 18 is folded over on itself.

To complete construction of the cap, the rear section 34 is folded along fold line 30 and telescopically inserted into the front section 32 as shown in FIG. 5. The same figure also shows that a small end section 60 of the crown 18 is folded over along the fold line 30 which defines the vertical end edge of the cap. Construction of the cap is completed by inserting rear section 34 into front section 32 between the upper and lower marginal edge portions 20 and 22 and the side panel 16.

FIG. 5 serves to illustrate that there is a major portion of rear section 34 to which the crown is not attached. It is this portion which has been the source of the problem described above in respect to use of the hat at larger sizes. The solution to the problem will become more apparent from the following description, particularly in reference to FIGS. 8 through 15.

Figure 7:
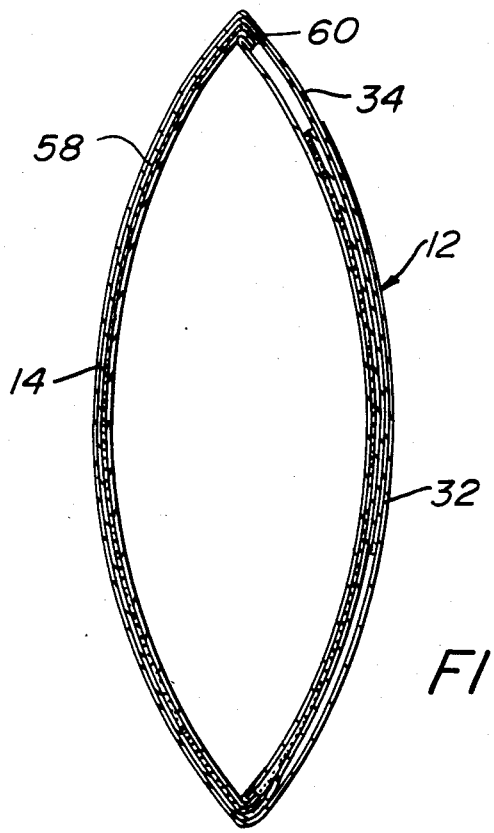
FIG. 7 is a horizontal sectional view of the cap taken along the line 7—7 in FIG. 6.

FIG. 6 is a vertical section of the cap 10 taken along the line 6—6 in FIG. 1, and FIG. 7 is a horizontal section taken along the line 7—7 in FIG. 6. FIG. 6 shows the crown partly extended such as it would appear before the cap is placed on the head of a person who uses it at relatively small sizes. For purposes of describing this cap 10, relatively small sizes can be considered headband sizes of 7 inches and smaller. Relatively large sizes can be considered to be headband sizes of $7\frac{5}{8}$ inches and larger.

As described above, the transverse distance of the panels defined by the central fold line 46 and the next adjacent fold lines 44 and 48 is smaller than the transverse width of the remaining panels. Consequently, fold line 46 does not project downwardly into the headband as far as fold lines 42 and 50. This means that there is more than $\frac{1}{4}$ inch additional space for the central part of the wearer's head front to back. This additional space is especially present when the headband is adjusted for smaller head sizes. When the headband is adjusted for larger head sizes, crown 18 expands until it is almost completely unfolded thus providing maximum amount available head room. But for smaller sizes, the reduced lower projection of at least the central fold line 46 provides additional head room and comfort for the wearer of smaller sizes. This is particularly true at the front and rear of the crown where the pleats are always more closely drawn together.

As stated above, a substantial open space exists between the crown 18 and rear section 38 when the hat is worn at relatively large headband sizes. See FIG. 5. The consequence of this is that there is nothing securing the rearmost portion of the pleated panels including the end section 60 to the headband 12. At large sizes, the wearer's head simply pushes this unsecured part of the crown 18 above the top most margin 24 of the headband 12 thus exposing his or her hair and/or scalp.

In accordance with the present invention, this problem is resolved by gluing pleated panels of the crown 18 to each other, preferably within the folded over section 60. Applying the glue in the folded over section 60 is preferable because it allows the crown to normally expand and prevents exposure of the hair or scalp. That is, the crown remains adjacent the headband and does not rise or pull away from it.

Figure 15:
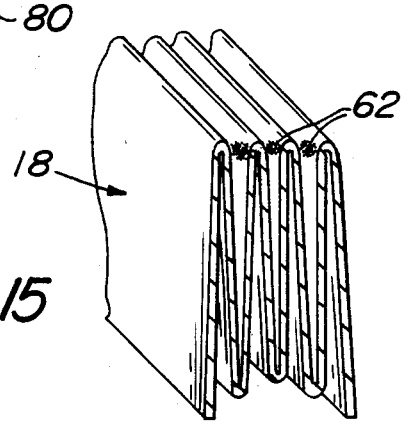

Although the panels can be glued one to each other in a number of ways, the preferred method of gluing them is illustrated in FIG. 15 where a spot of adhesive 62 is placed between each of the pleated panels adjacent its uppermost margin. The advantage of placing the adhesive at this position is that it best lends itself to automated application, and maximum expansion of the crown while still providing protection.

Figure 8:
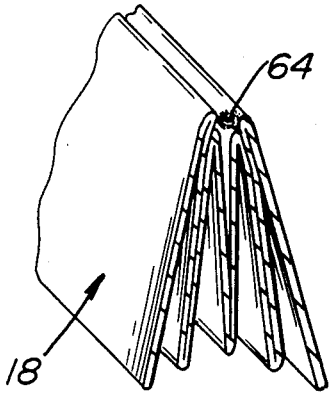
FIGS. 8 through 15 are fragmentary perspective views of the crown showing how the respective panels may be joined together to prevent the crown from popping out of the band.

FIGS. 8–14 illustrate other methods for applying adhesive at varying positions within the pleats. In FIG. 8, a single spot of adhesive 64 is applied to all of the marginal edges with the headband in its collapsed position.

Figure 9:
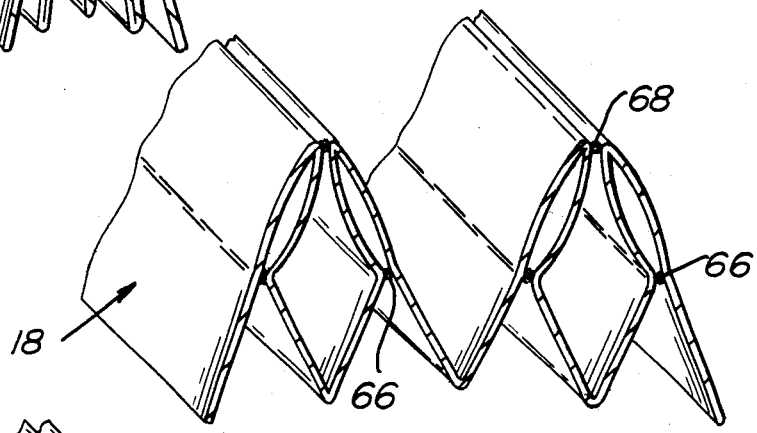
Figure 10:
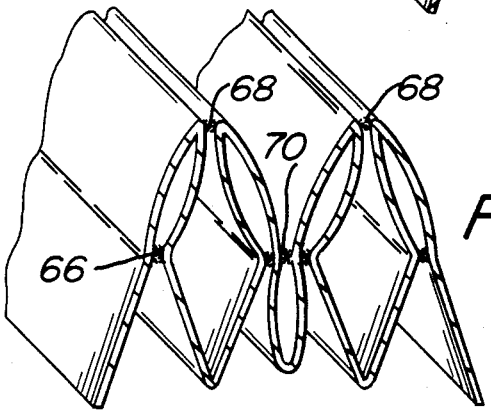

In FIG. 9, spots of adhesive 66 are placed between every other pleated panel intermediate the fold lines. In addition, spots of adhesive 68 are placed adjacent the upper edge of the outermost pleated panels. FIG. 10 illustrates a modification of the embodiment illustrated in FIG. 9 wherein an additional intermediate spot of adhesive 70 is placed between the central pleated panels.

Figure 11:
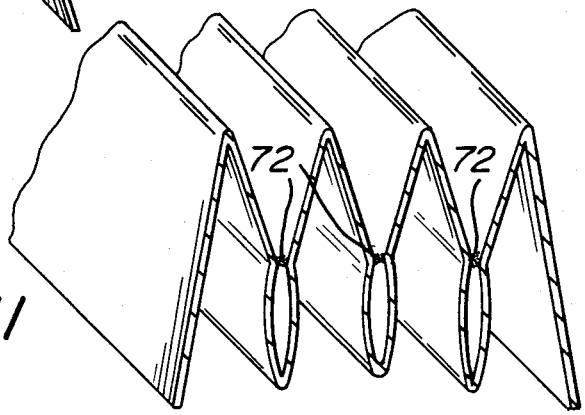
Figure 12:
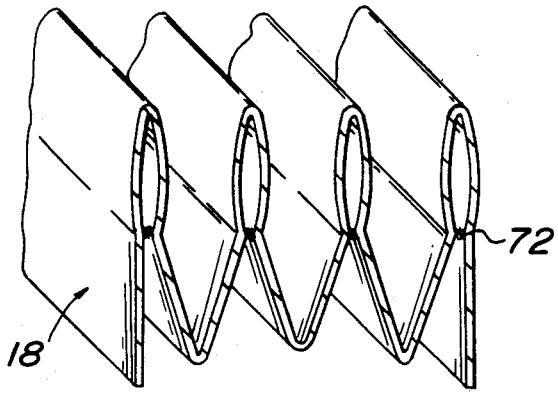

FIG. 11 illustrates an embodiment wherein only intermediate spots of adhesive 72 are positioned between every other pair of panels. FIG. 12 shows a modification of the embodiment illustrated in FIG. 11 wherein the outermost panels are adhered to each other rather than the intermediate panels.

Figure 13:
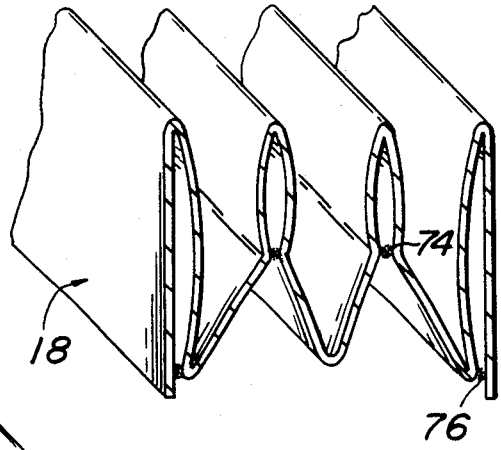
Figure 14:
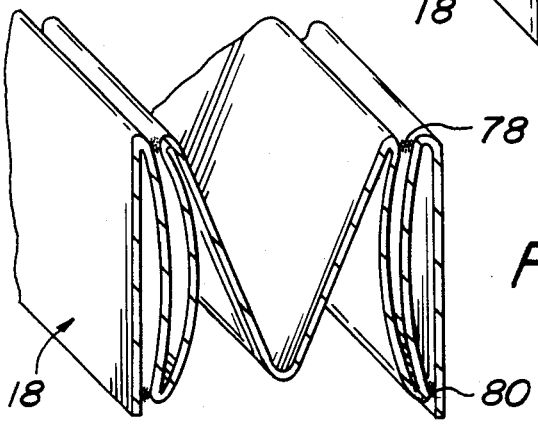

FIGS. 13 and 14 show other positions for applying the adhesive between the pleated panels. In FIG. 13 spots of adhesive 74 and 76 are applied intermediate the panels and at the lower marginal edges as illustrated. FIG. 14 shows the application of spots of adhesive 78 and 80 at the top and bottom marginal edges of selected pleated panels.

Regardless of the configuration used, the application of the adhesive between the pleated panels retains the crown 18 fully within the headband 12 thus maintaining the integrity of the cap which is particularly important when used where ventilation is important. This provides a practical and effective solution to the problem of exposing portions of the wearer's head. It should be noted that although maybe some suggestion in the prior art that the adhesive strip 58 inherently attaches to the ends of the panels of the crown 18 when it is folded over, this does not occur as a practical matter. Even in its collapsed condition, the crown 18 is not sufficiently thick to cause the panels to be individually exposed to the adhesive strip.

It should also be recognized that for the purpose of illustration, the present invention includes 8 pleated panels in crown 18. It may, however, be desirable to include a greater number such as 12 although 8 a hat assembled with the described dimensions has been found to provide a crown for a cap that functions quite satisfactorily.

The present invention may be embodied in other specific forms without departing from the spirit or essential attributes thereof and, accordingly, reference should be made to the appended claims, rather than to the foregoing specification, as indicating the scope of the invention.

I claim:

1. A cap comprising an adjustable headband and a crown secured to the headband, said headband comprising an elongated sheet folded to define coextensive first and second side panels with each panel having opposed upper and lower longitudinally extending edges, each of said first and second side panels having respective upper and lower marginal edge portions folded relatively inwardly at each respective upper and lower edge, said band being folded about transverse fold lines to define said first and second side panels, said second side panel being formed with a front section and a rear section extending in longitudinally aligned relationship with adjacent ends of the front and rear sections telescopically interconnected to permit relative longitudinal displacement thereof for selective size adjustment, an elongated crown formed from flexible sheet material with a plurality of longitudinally extending pleated panels and having an outermost pleated panel at each side thereof secured to an inwardly facing surface of a respective upper marginal edge portion of said first and second side panels, said pleated panels being disposed in coplanar relationship to said side panels when said crown is collapsed to a fully folded configuration, the transverse dimension from lower fold line to upper fold line of the central pleated panels being less than the corresponding transverse dimension of the more lateral pleated panels, and when the crown is collapsed to a fully folded configuration, the upper fold lines of said pleated panels being equally spaced from the upper longitudinally extending edges of said first and second side panels.

2. A cap according to claim 1 wherein selected ones of said pleated panels are secured to each other adjacent the transverse fold lines defining the first and second side panels of said headband.

3. A cap according to claim 2 wherein said pleated panels are secured to each other at a position intermediate the upper and lower fold lines of said pleated panels.

4. A cap according to claim 2 wherein said pleated panels are secured to each other at a position adjacent the upper fold lines of said pleated panels.

5. A cap according to claim 2 wherein the lateral pleated panels are secured to each other but not the central pleated panels.

6. A cap comprising an adjustable headband and a crown secured to the headband, said crown being elongated and formed from a flexible sheet of material with a plurality of logitudinally extending pleated panels and having an outermost pleated panel at each side thereof secured to an inwardly facing surface of said headband, said pleated panels being disposed in coplanar relationship to said headband when said crown is collapsed to a fully folded configuration, the transverse dimension from the lower fold line to the upper fold line of the central unsecured pleated panels being less than the corresponding transverse dimension of the more lateral unsecured pleated panels of said crown.

7. A cap according to claim 1 wherein:

said crown has a rear vertical end edge section formed by having the pleated panels reverse folded upon themselves, and selected ones of said pleated panels being secured to each other within the reverse folded section.

8. An adjustable cap according to claim 7 wherein said pleated panels are secured to each other at a position intermediate the upper and lower fold lines of said pleated panels.

9. A cap according to claim 7 wherein said pleated panels are secured to each other at a position adjacent the upper fold lines of said pleated panels.

10. A cap according to claim 7 wherein the lateral pleated panels are secured to each other but not the central pleated panels.

* * * * *